US011808437B1

(12) United States Patent
Huang et al.

(10) Patent No.: US 11,808,437 B1
(45) Date of Patent: Nov. 7, 2023

(54) LIGHTING APPARATUS

(71) Applicant: LEEDARSON LIGHTING CO., LTD., Fujian (CN)

(72) Inventors: Huiyong Huang, Fujian (CN); Zhenyu Tang, Fujian (CN); Shuxing Gao, Fujian (CN)

(73) Assignee: LEEDARSON LIGHTING CO., LTD., Fujian (CN)

( * ) Notice: Subject to any disclaimer, the term of this patent is extended or adjusted under 35 U.S.C. 154(b) by 0 days.

(21) Appl. No.: 18/072,670

(22) Filed: Nov. 30, 2022

(30) Foreign Application Priority Data

| | | |
|---|---|---|
| Apr. 22, 2022 | (CN) | 202220950887.0 |
| Apr. 28, 2022 | (CN) | 202221037449.1 |
| Apr. 29, 2022 | (CN) | 202221039634.4 |
| May 10, 2022 | (CN) | 202221117814.X |
| May 10, 2022 | (CN) | 202221125061.7 |

(51) Int. Cl.
*F21V 21/14* (2006.01)

(52) U.S. Cl.
CPC ..... *F21V 21/14* (2013.01)

(58) Field of Classification Search
CPC ..... F21V 13/02
See application file for complete search history.

(56) References Cited

U.S. PATENT DOCUMENTS

| | | | | |
|---|---|---|---|---|
| 10,480,996 | B2 * | 11/2019 | Roberts | F21V 23/0471 |
| 2014/0071679 | A1 * | 3/2014 | Booth | F21S 8/026 362/249.02 |
| 2014/0160736 | A1 * | 6/2014 | Chung | F21V 7/0016 362/249.02 |
| 2016/0312987 | A1 * | 10/2016 | Danesh | F21S 8/024 |
| 2019/0301710 | A1 * | 10/2019 | Harris | F21S 8/026 |
| 2020/0124270 | A1 * | 4/2020 | Spencer | G09G 3/3426 |
| 2022/0104320 | A1 * | 3/2022 | Jiang | F21V 23/04 |
| 2022/0202972 | A1 * | 6/2022 | Chen | F21V 23/003 |

* cited by examiner

*Primary Examiner* — Christopher E Dunay
(74) *Attorney, Agent, or Firm* — Chun-Ming Shih; LANWAY IPR SERVICES

(57) ABSTRACT

A lighting apparatus includes a first light source, a cup housing, a surface rim and a lateral light module. The cup housing has a concave container and a light opening. The first light source is placed within the concave container for emitting a first light via the light opening. The a surface rim with an inner edge connected to the light opening of the cup housing. The concave container of the cup housing is inserted to an installation cavity. The surface rim has a larger diameter than the installation cavity to conceal the installation cavity. The installation cavity is extended inwardly from a installation surface. The surface rim has a upper surface facing to the installation surface. The lateral light module is disposed between the upper surface of the surface rim and the installation surface for emitting a second light.

17 Claims, 8 Drawing Sheets

LIGHTING APPARATUS

FIELD

The present invention is related to a lighting apparatus, and more particularly related to a lighting apparatus with multiple light sources.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

People rely on various light devices in daily life. Most time, light devices are used for illumination so that people can see things in darkness.

In some circumstances, people would like to have to low light to feel comfortable. For example, in deep night, some people may need a night light to keep them feeling safe.

However, it is a cost and inconvenient if people need to dispose different light devices for different purposes. Therefore, it is beneficial if we can design a light device with more functions.

SUMMARY

In some embodiments, a lighting apparatus includes a first light source, a cup housing, a surface rim and a lateral light module.

The cup housing has a concave container and a light opening.

The first light source is placed within the concave container for emitting a first light via the light opening.

The surface rim with an inner edge connected to the light opening of the cup housing.

The concave container of the cup housing is inserted to an installation cavity.

The surface rim has a larger diameter than the installation cavity to conceal the installation cavity.

The installation cavity is extended inwardly from a installation surface. The surface rim has a upper surface facing to the installation surface.

The lateral light module is disposed between the upper surface of the surface rim and the installation surface for emitting a second light.

The light direction of the second light and the first light has an angle larger than 30 degrees.

In some embodiments, the lateral light module surrounds an exterior surface of the cup housing.

In some embodiments, the lateral light module is disposed between the upper surface of the surface rim and the installation surface.

In some embodiments, the lateral light module has a elastic layer facing to the installation surface.

In some embodiments, the lateral light module has a ring structure with a ring opening to insert the cup housing.

In some embodiments, the cup housing has a power socket to coupled to a second light source in the lateral light module.

In some embodiments, the lateral light module receives a control signal from the power socket to control an operation of the second light source.

In some embodiments, the first light source receives a driving current from a driver.

The driver generates a lateral current supplied to the second light source via a coil for wirelessly transmitting the lateral current to the second light source.

The lateral module is separated from the cup housing with a separating wall.

In some embodiments, the lateral light module has a power connector for connecting to an external power source.

The first light source receives a driving current from a driver.

The driver independently receives the external power source.

In some embodiments, the second light source is controlled with a wireless command from the driver.

In some embodiments, the lateral light module is detachable from the cup housing to be replaced with another lateral light module.

In some embodiments, a function module is selectively further stacked between the installation surface and the upper surface of the surface rim.

In some embodiments, the function module is a speaker module to generate a sound.

In some embodiments, the first light source and the second light source are disposed on a same light source plate.

A bottom of a reflective cup separates the first light source from the second light source.

An inner surface of the reflective cup guides the first light to the light opening.

An exterior surface of the reflective cup guides the second light to a lateral opening of lateral light module.

In some embodiments, the lateral light module has a separate housing from the cup housing.

The second light source is disposed in the separate housing.

In some embodiments, the second light module has a second light source, the second light of the second light source has a lower light intensity than the first light of the first light source to be used a night light source.

In some embodiments, the lateral light module has a first part and a second part respectively with C-shape structure to be assembled as a ring structure.

In some embodiments, the lateral light module is rotatable with respect to the cup housing to change a output direction of the second light.

In some embodiments, the lateral light module has a motion detector to automatically turn on when detecting a human motion.

In some embodiments, the lateral light module has a timer to automatically turn off after a predetermined time period.

DETAILED DESCRIPTION

Figure 4:
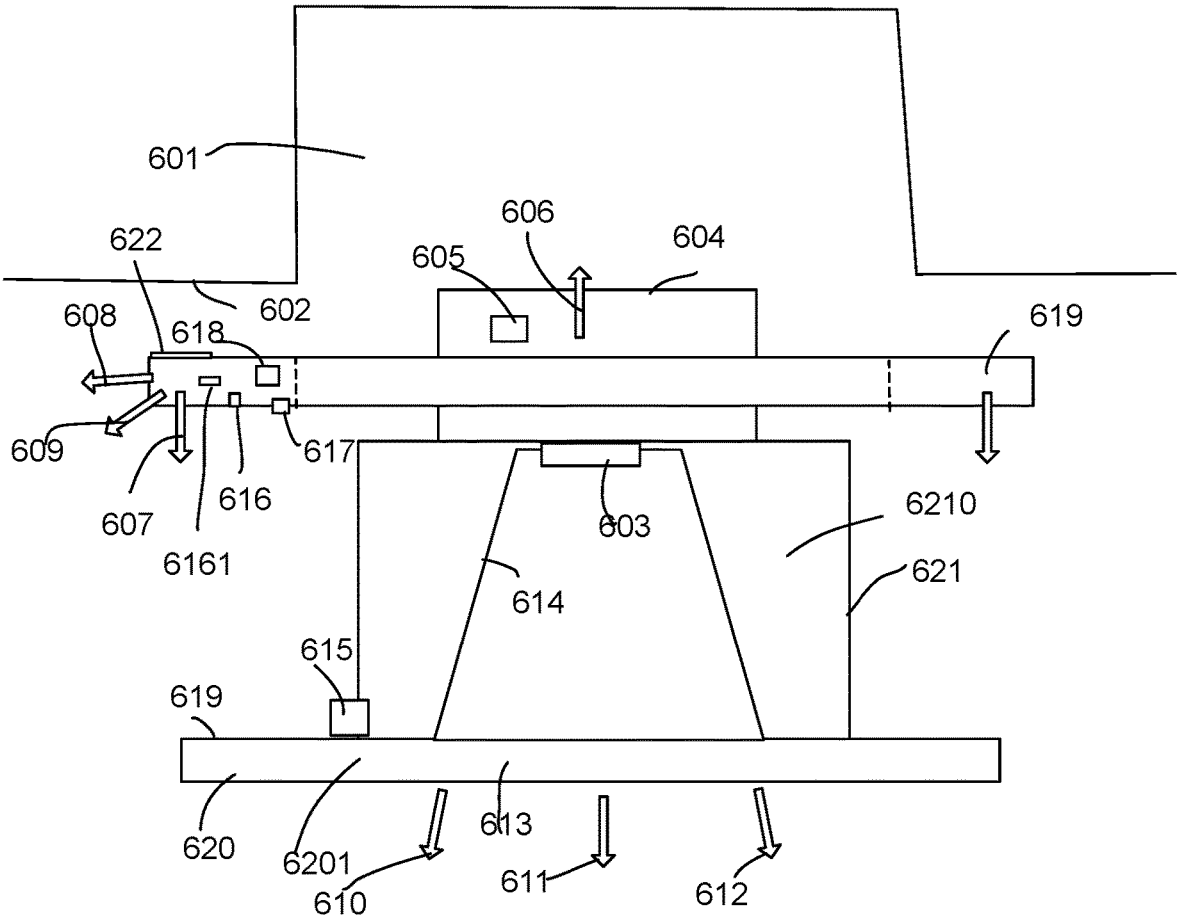
FIG. 4 shows another embodiment of a lighting apparatus.

In FIG. 4, a lighting apparatus includes a first light source 603, a cup housing 621, a surface rim 620 and a lateral light module 619.

The lateral light module 619 is a ring structure has a central opening. During installation, the cup housing 621 passes through the central opening by moving the lateral light module in a first direction 607. After the lateral light module 619 is assembled to the cup housing 621, the lighting apparatus is inserted into an installation cavity 601 in a second direction 606.

The cup housing 621 has a concave container 6210 and a light opening 613.

The first light source 603 is placed within the concave container 6210 for emitting a first light 610, 611, 612 via the light opening 613.

The surface rim 620 has an inner edge 6201 connected to the light opening 613 of the cup housing 621. Specifically, the surface rim is a ring shape with an inner circular edge. The inner circular edge is connected to the light opening defined by the bottom edge of the cup housing 621. The surface rim 620 and the cup housing 621 may be made as a single piece of component or two components assembled together.

The concave container 6120 of the cup housing 621 is inserted to an installation cavity 601.

The surface rim 620 has a larger diameter than the installation cavity 601 to conceal the installation cavity 601.

In other words, when the lighting apparatus is installed to the installation cavity 601, which may be an empty hole or a junction box, the opening of the installation cavity is concealed by the surface rim 620.

The installation cavity 601 is extended inwardly from a installation surface 602, e.g. a ceiling. The surface rim 620 has a upper surface 619 facing to the installation surface 602.

The lateral light module 619 is disposed between the upper surface 619 of the surface rim 620 and the installation surface 602 for emitting a second light 608, 609.

The light direction of the second light 608, 609 and the first light 610, 611, 612 may have an angle larger than 30 degrees in some embodiments. In some other embodiments, when the lateral light module may have a larger diameter than the surface rim and thus may emit light downwardly just like the first light.

In some embodiments, the lateral light module 619 surrounds an exterior surface of the cup housing 621. Another example in FIG. 2 will clearly show such spatial relation.

In some embodiments, the lateral light module is disposed between the upper surface of the surface rim and the installation surface.

In FIG. 4, the lateral light module has an elastic layer 622 facing to the installation surface 602. Such elastic layer 622 may be a foam or other flexible material layer to ensure the top surface of the lateral light module closely engaging the installation surface 602, to prevent dust or other thing entering the installation cavity 601.

In some embodiments, the lateral light module 619 has a ring structure with a ring opening to insert the cup housing.

In some embodiments, the cup housing has a power socket 615 to coupled to a second light source in the lateral light module. For example, the lateral light module 619 has a corresponding power socket 617 to electrically couple to the power socket 615 to route electricity from a driver 605 to the second light source 618.

In some embodiments, the lateral light module 619 receives a control signal from the power socket 615 to control an operation of the second light source 618.

In some embodiments, the first light source 603 receives a driving current from a driver 605. The driver 605 in this example is placed in a driver box 604 stacked above the cup housing 621.

In some embodiments, the driver generates a lateral current supplied to the second light source via a coil for wirelessly transmitting the lateral current to the second light source.

Figure 6:
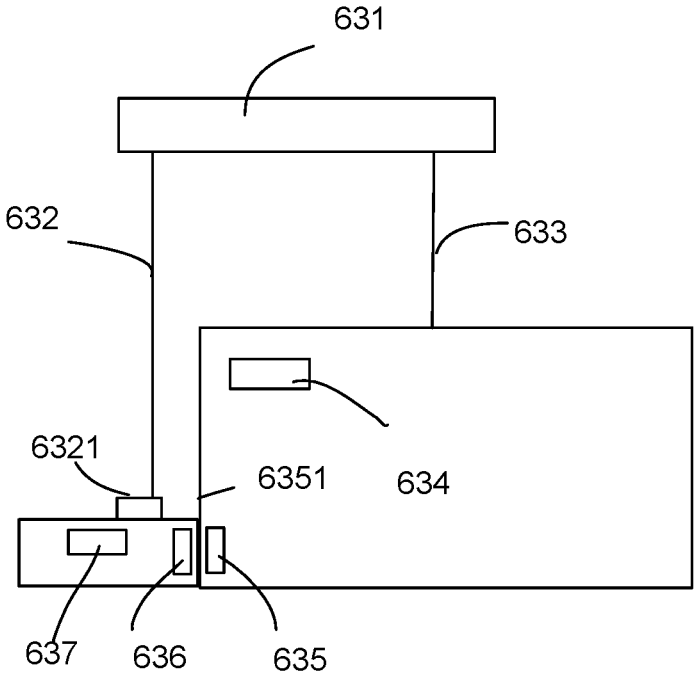
FIG. 6 shows several ways for routing electricity and commands.

FIG. 6 shows such an example. In FIG. 6, there is a first coil 635 to receives electricity from a driver 634. There is a second coil 635 disposed in a lateral light module. By using wireless charging mechanism, energy may be transmitted from the first coil 635 to the second coil 636 even there is a wall separating the first coil 635 and the second coil 636. Such energy transmission is known to person skilled in the art, but not known to be used in such solution, yet.

The lateral module is separated from the cup housing with a separating wall 6351.

FIG. 6 also illustrates another way to supply power to the first light source and the second light source.

In FIG. 6, the lateral light module has a power connector 6321 for connecting to an external power source 631 via a power wire 632.

The first light source receives a driving current from a driver 634.

The driver 634 independently receives the external power source 631 via another power wire 633. In other words, in such case, the lateral light module with the second light source and the main light module that encloses the first light source receive power separately, thus making the design scalable. A traditional downlight may even be combined with lateral light module without any modification.

In other words, in such embodiments, users buy the lateral light module, and insert their traditional downlight into the ring opening of the lateral light module. The power wires are separately connected to the lateral light module and the traditional downlight.

In some embodiments, the second light source is controlled with a wireless command from the driver. For example, the driver may transmits a wireless command in Bluetooth, a Wi-Fi or other wireless signal that is receive by the lateral light module to control the second light source 637.

In some embodiments, the lateral light module is detachable from the cup housing to be replaced with another lateral light module.

In such design, people may integrate different lateral light module to fit their special needs, e.g. differing night light color.

In some embodiments, a function module is selectively further stacked between the installation surface and the upper surface of the surface rim.

In some embodiments, the function module is a speaker module to generate a sound.

Figure 7:
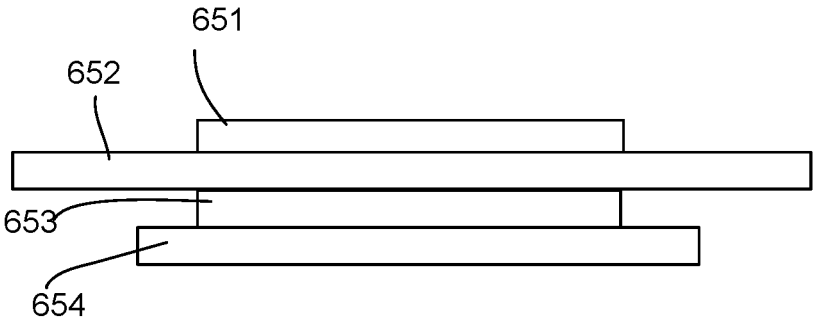
FIG. 7 shows multiple components stacked to provide more functions.

FIG. 7 shows such an example, a speaker module 651 is stacked above a lateral light module 652. The lateral light module 652 is further stacked above another function module 653. The function module 653 is stacked above the surface rim 654. These components may be stacked by reserving ring openings for cup housing to insert therethrough to add flexible function when necessary.

Figure 8:
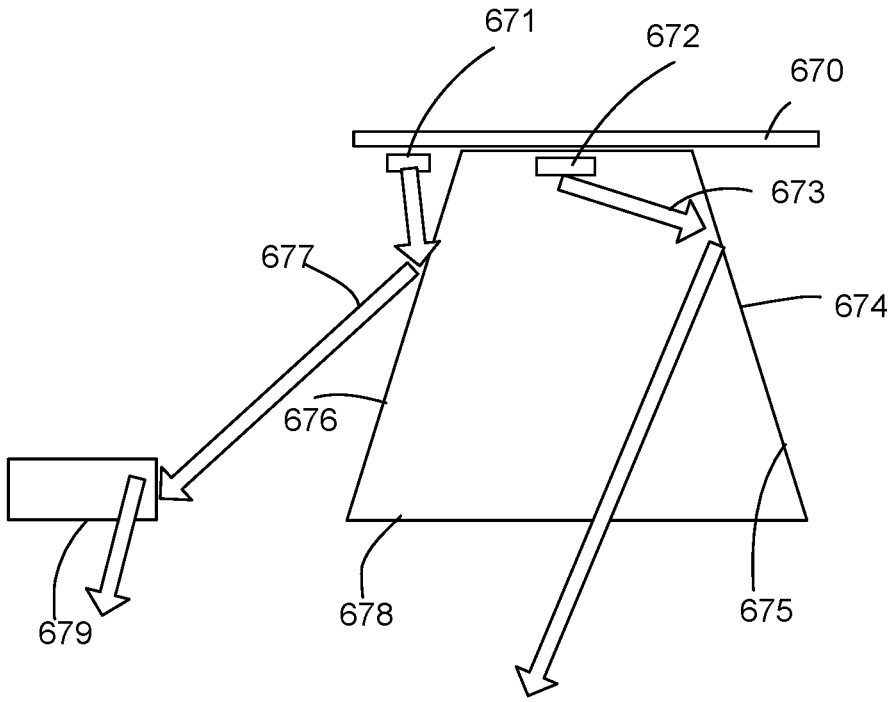
FIG. 8 shows a reflective cup used for separating a first light source and a second light source.

In FIG. 8, the first light source 672 and the second light source 671 are disposed on a same light source plate 670.

A bottom of a reflective cup 674 separates the first light source 672 from the second light source 671.

An inner surface 675 of the reflective cup 674 guides the first light 673 to the light opening 678.

An exterior surface 676 of the reflective cup 674 guides the second light 677 to a lateral opening 679 of lateral light module.

In some embodiments, the lateral light module has a separate housing from the cup housing.

The second light source is disposed in the separate housing, as illustrated in FIG. 4.

In some embodiments, the second light module has a second light source, the second light of the second light source has a lower light intensity than the first light of the first light source to be used a night light source.

Figure 5:
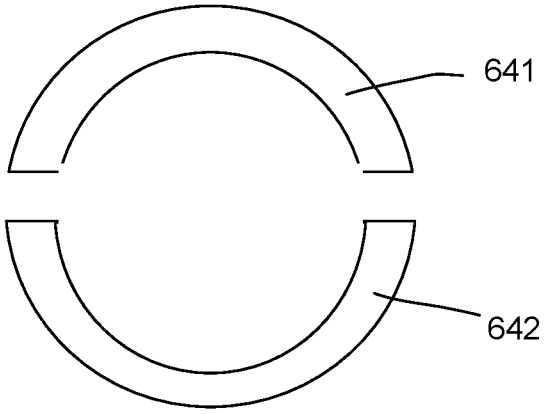
FIG. 5 shows a lateral light module assembled by two C-shape components.

In FIG. 5, the lateral light module has a first part 641 and a second part 642 respectively with C-shape structure to be assembled as a ring structure.

In some embodiments, the lateral light module is rotatable with respect to the cup housing to change a output direction of the second light. Users may rotate the lateral module to change a light opening direction.

In FIG. 4, the lateral light module has a motion detector 616 to automatically turn on when detecting a human motion.

In some embodiments, the lateral light module has a timer 6161 to automatically turn off after a predetermined time period.

The first light source is also controlled by the driver to mix a desired color temperature or a color.

Figure 1:
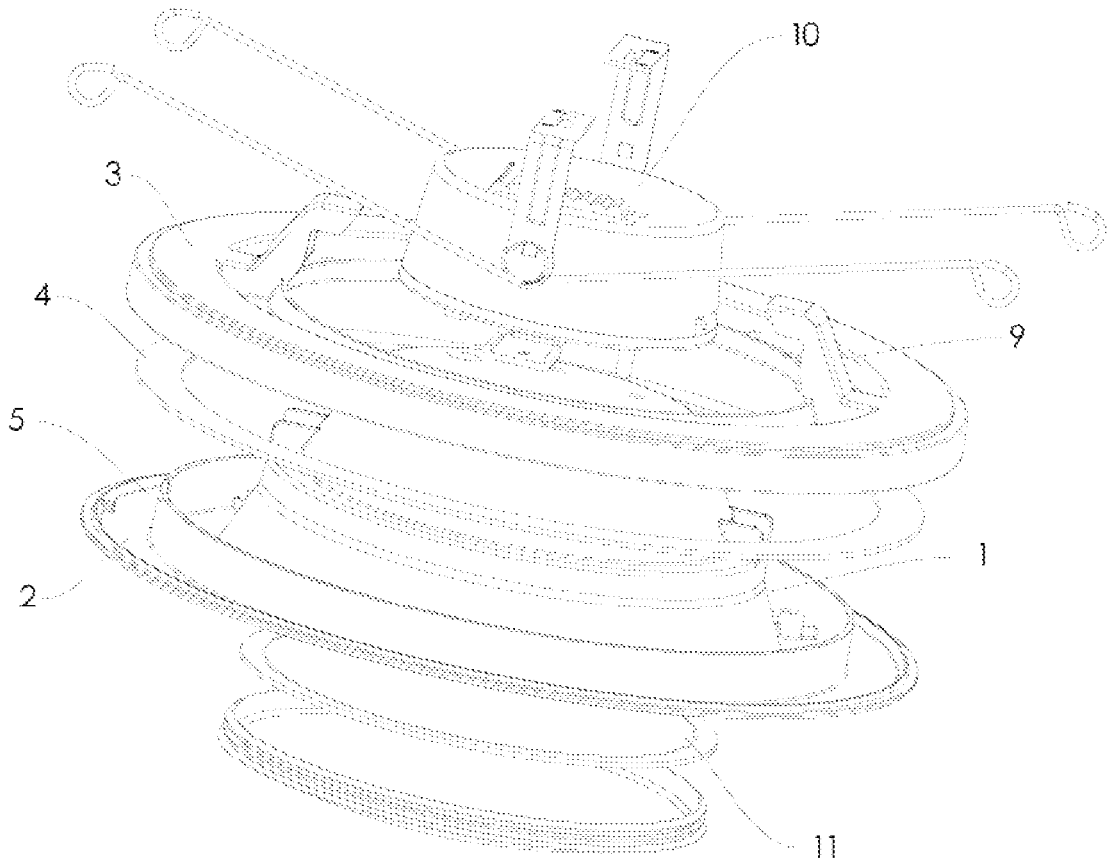
FIG. 1 illustrates a lighting apparatus embodiment.

FIG. 1 shows another lighting apparatus embodiment.

In FIG. 1, a lighting apparatus has a driver box 10 containing a driver for storing a driver to convert an external power source like 110V AC power to a driving current to a first light source.

There is a cup housing 1 inserted through a ring opening of the lateral light module.

There is a wire channel 9 to route electricity and control signal between the driver and the lateral light module.

A second light source 4 is placed in the lateral light module. A light passing cover 3 of the lateral module encloses the second light source 4.

There is a reflective part 5 for guiding the second light of the second light source. A surface rim 2 conceals the installation cavity. A reflective cup 11 is installed for guiding the first light of the first light source as mentioned above.

Figure 2:
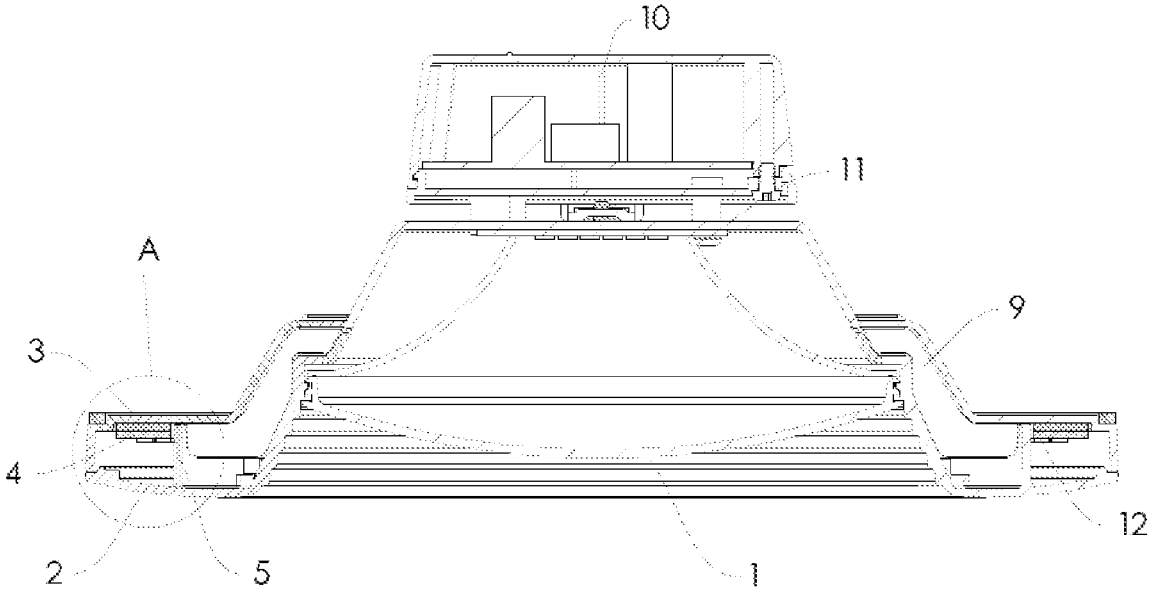
FIG. 2 shows a side view of the example in FIG. 1.

FIG. 2 shows a side view of the embodiment in FIG. 1.

In FIG. 2, the same reference numerals as to FIG. 1 refer to the same components.

In FIG. 2, the driver box 10 contains a driver to provides power to the first light source 11 and the second light source 4. The cup housing 1 is surrounded by the lateral light module. Wires are placed in the wire channel 9. There is a ring concave 12 for placing the second light source 4. The reflective part 5 guides the light of the second light source 4 to a desired direction passing through the light passing cover 3. The surface rim 2 conceals the installation cavity.

Figure 3:
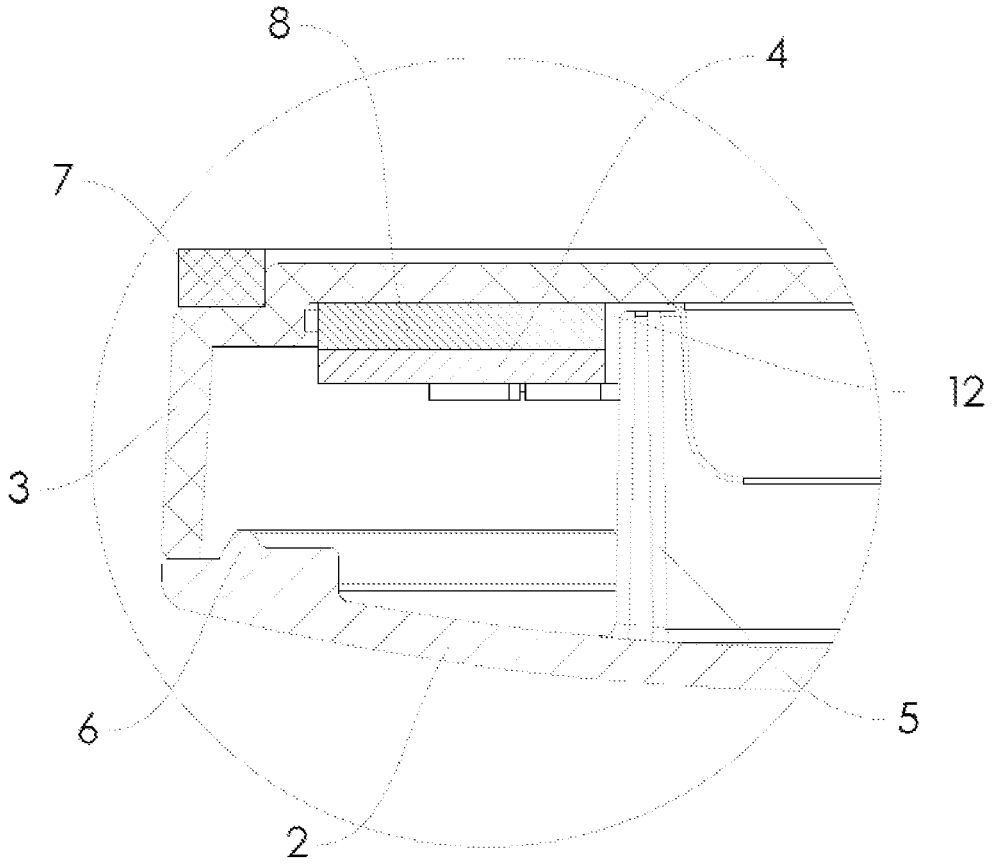
FIG. 3 shows a zoom-up view of a portion of the example in FIG. 1.

FIG. 3 shows a zoom-up view of the area A in FIG. 2.

In FIG. 3, there is an elastic layer 7 to closely engaging the installation surface like a ceiling. The light passing cover 3 allows light of the lateral light module to provide a night light effect. There is a ring convex structure 6 for assembling the light passing cover 3. The surface rim 2 conceals the installation cavity. The reflective part 5 reflects light of the second light source 4 to a desired direction. The ring concave 12 is used for holding components of lateral light module. There is a heat dissipation plate 8 for carrying away heat generated by the second light source 4.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus comprising:

a first light source;

a cup housing with a concave container and a light opening, wherein the first light source is placed within the concave container for emitting a first light via the light opening;

a surface rim with an inner edge connected to the light opening of the cup housing, wherein the concave container of the cup housing is inserted to an installation cavity, wherein the surface rim has a larger diameter than the installation cavity to conceal the installation cavity, wherein the installation cavity is extended inwardly from a installation surface, the surface rim has a upper surface facing to the installation surface; and a lateral light module disposed between the upper surface of the surface rim and the installation surface for emitting a second light, wherein the lateral light module surrounds an exterior surface of the cup housing, wherein the lateral light module has a ring structure with a ring opening to insert the cup housing, wherein the first light source receives a driving current from a driver, wherein the driver generates a lateral current supplied to the second light source via a coil for wirelessly transmitting the lateral current to the second light source, wherein the lateral module is separated from the cup housing with a separating wall.

2. The lighting apparatus of claim 1, wherein the lateral light module is disposed between the upper surface of the surface rim and the installation surface.

3. The lighting apparatus of claim 2, wherein the lateral light module has an elastic layer facing to the installation surface.

4. The lighting apparatus of claim 1, wherein the cup housing has a power socket to coupled to a second light source in the lateral light module.

5. The lighting apparatus of claim 4, wherein the lateral light module receives a control signal from the power socket to control an operation of the second light source.

6. The lighting apparatus of claim 1, wherein the lateral light module has a power connector for connecting to an external power source, wherein the first light source receives a driving current from a driver, wherein the driver independently receives the external power source.

7. The lighting apparatus of claim 6, wherein the second light source is controlled with a wireless command from the driver.

8. The lighting apparatus of claim 1, wherein the lateral light module is detachable from the cup housing to be replaced with another lateral light module.

9. The lighting apparatus of claim 1, wherein a function module is selectively further stacked between the installation surface and the upper surface of the surface rim.

10. The lighting apparatus of claim 9, wherein the function module is a speaker module to generate a sound.

11. The lighting apparatus of claim 1, wherein the first light source and the second light source are disposed on a same light source plate, wherein a bottom of a reflective cup separates the first light source from the second light source, wherein an inner surface of the reflective cup guides the first light to the light opening, wherein an exterior surface of the reflective cup guides the second light to a lateral opening of lateral light module.

12. The lighting apparatus of claim 1, wherein the lateral light module has a separate housing from the cup housing, wherein the second light source is disposed in the separate housing.

13. The lighting apparatus of claim 1, wherein the second light module has a second light source, the second light of the second light source has a lower light intensity than the first light of the first light source to be used a night light source.

14. The lighting apparatus of claim 1, wherein the lateral light module has a first part and a second part respectively with C-shape structure to be assembled as a ring structure.

15. The lighting apparatus of claim 1, wherein the lateral light module is rotatable with respect to the cup housing to change a output direction of the second light.

16. The lighting apparatus of claim 1, wherein the lateral light module has a motion detector to automatically turn on when detecting a human motion.

17. The lighting apparatus of claim 1, wherein the lateral light module has a timer to automatically turn off after a predetermined time period.

* * * * *